US006123282A

United States Patent [19]

Richman

[11] Patent Number: 6,123,282

[45] Date of Patent: Sep. 26, 2000

[54] TROLLING SYSTEM FOR BASEBALL AND PLAYER ENDORSEMENTS

[76] Inventor: Marc Richman, 1002 Poinsettia Rd., Delray Beach, Fla. 33483

[21] Appl. No.: 09/281,033

[22] Filed: Mar. 30, 1999

Related U.S. Application Data

[60] Provisional application No. 60/123,213, Mar. 8, 1999.

[51] Int. Cl.[7] ..... A63B 47/02

[52] U.S. Cl. ..... 242/400; 242/405; 294/19.2; 294/99.1

[58] Field of Search ..... 242/395, 395.1, 242/405, 405.3, 400; 294/19.2, 99.1

[56] References Cited

U.S. PATENT DOCUMENTS

| | | | |
|---|---|---|---|
| 2,406,874 | 9/1946 | Walker | 242/395 |
| 2,526,084 | 10/1950 | Penn | 294/19.2 |
| 4,601,440 | 7/1986 | Wang | 242/395.1 |
| 5,388,877 | 2/1995 | Wenk | 242/395.1 |
| 5,462,326 | 10/1995 | Doherty | 294/19.2 |
| 5,947,790 | 9/1999 | Gordon | 242/405.3 |

*Primary Examiner*—Katherine A. Matecki
*Attorney, Agent, or Firm*—Robert C. Kain, Jr.

[57] ABSTRACT

The trolling system for obtaining player endorsements on a baseball includes a drop cord, a reel which contains and holds the wound-up drop cord and a retractable ball basket. The retractable ball basket is attached at a terminal of the drop cord opposite the reel. The ball basket has a plurality of spaced apart and inwardly biased ribs. These ribs establish a ball container in a central region of the ball basket. Since the ribs are spaced apart and peripherally biased together at one end, the baseball player can rotate the baseball, identify an available endorsement area, and sign or endorse the baseball. Subsequent thereto, the fan can retract the ball basket by winding the drop cord on the reel thereby retrieving the ball from the lower elevation near the baseball player to the fan's elevated elevation in the stadium stands. The trolling system can be adapted for basketballs, footballs, soccer balls, tennis balls, hockey pucks and golf balls simply by changing the shape of the retractable ball basket.

16 Claims, 4 Drawing Sheets

TROLLING SYSTEM FOR BASEBALL AND PLAYER ENDORSEMENTS

This patent application claims the benefit of provisional patent application No. 60/123,213 filed on Mar. 8, 1999, now pending.

The invention relates to a trolling system for baseball and player endorsements on baseballs, footballs, basketballs, soccer balls, tennis balls, golf balls and hockey pucks.

BACKGROUND OF THE INVENTION

It is common in stadiums and arenas to separate the visitors or members of the public from the ballplayers, particularly when the ballplayers are entering or exiting the stadium, arena or playing field. This physical separation normally includes fencing and significant elevation between the visitors (the paying customers) and the ballplayers.

Many individuals, both young and old adults, desire to obtain a written endorsement of a ballplayer on the ball used by the player during the game or event. For example, young boys customarily seek signatures (written endorsements) on baseballs at baseball stadiums from baseball players. In a similar manner, basketball players sometimes endorse basketballs and football players endorse footballs. The same is true regarding soccer, tennis, hockey and golf.

However, a problem rises in that the fans seeking written endorsements of the players are separated by elevation and fencing from the players as they enter or exit the playing field. The present invention provides an apparatus to solve the elevational problem and obtain ballplayer endorsements on balls utilized during the game.

OBJECTS OF THE INVENTION

It is an object of the present invention to provide a trolling system for baseballs and ballplayer endorsements for wide range of sports.

It is another object of the present invention to provide a trolling system wherein fans, seeking the written endorsement on a ball from a ballplayer, can lower the ball to the player and the player can rotate or change the orientation of the ball in a ball basket thereby enabling endorsement at various locations on the ball.

It is an additional object of the present invention to provide a trolling system wherein the ball can be rotated in the basket to expose an available endorsement area on the ball.

It is a further object of the present invention to provide a trolling system which includes a reel enabling the fan to compactly gather and dispense a drop cord extending between the reel and the ball basket.

It is another object of the present invention to provide a ball basket which can be adopted to carry or retain various types of balls utilized in arenas and stadiums.

SUMMARY OF THE INVENTION

The trolling system for obtaining player endorsements on a baseball includes a drop cord, a reel which contains and holds the wound-up drop cord and a retractable ball basket. The retractable ball basket is attached at a terminal of the drop cord opposite the reel. The ball basket has a plurality of spaced apart and inwardly biased ribs. These ribs establish a ball container in a central region of the ball basket. Since the ribs are spaced apart and peripherally biased together at one end, the baseball player can rotate the baseball, identify an available endorsement area, and sign or endorse the baseball. Subsequent thereto, the fan can retract the ball basket by winding the drop cord on the reel thereby retrieving the ball from the lower elevation near the baseball player to the fan's elevated elevation in the stadium stands. The trolling system can be adapted for basketballs, footballs, soccer balls, tennis balls, hockey pucks and golf balls, simply by changing the shape of the retractable ball basket.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a trolling system specifically designed for a baseball in order to obtain ballplayer endorsements. However, the trolling system can be modified to permit football fans, soccer fans, tennis fans, basketball fans, hockey fans, golf fans to obtain endorsements from appropriate ballplayers at sporting arenas, auditoriums and stadiums.

Figures 1, 2:
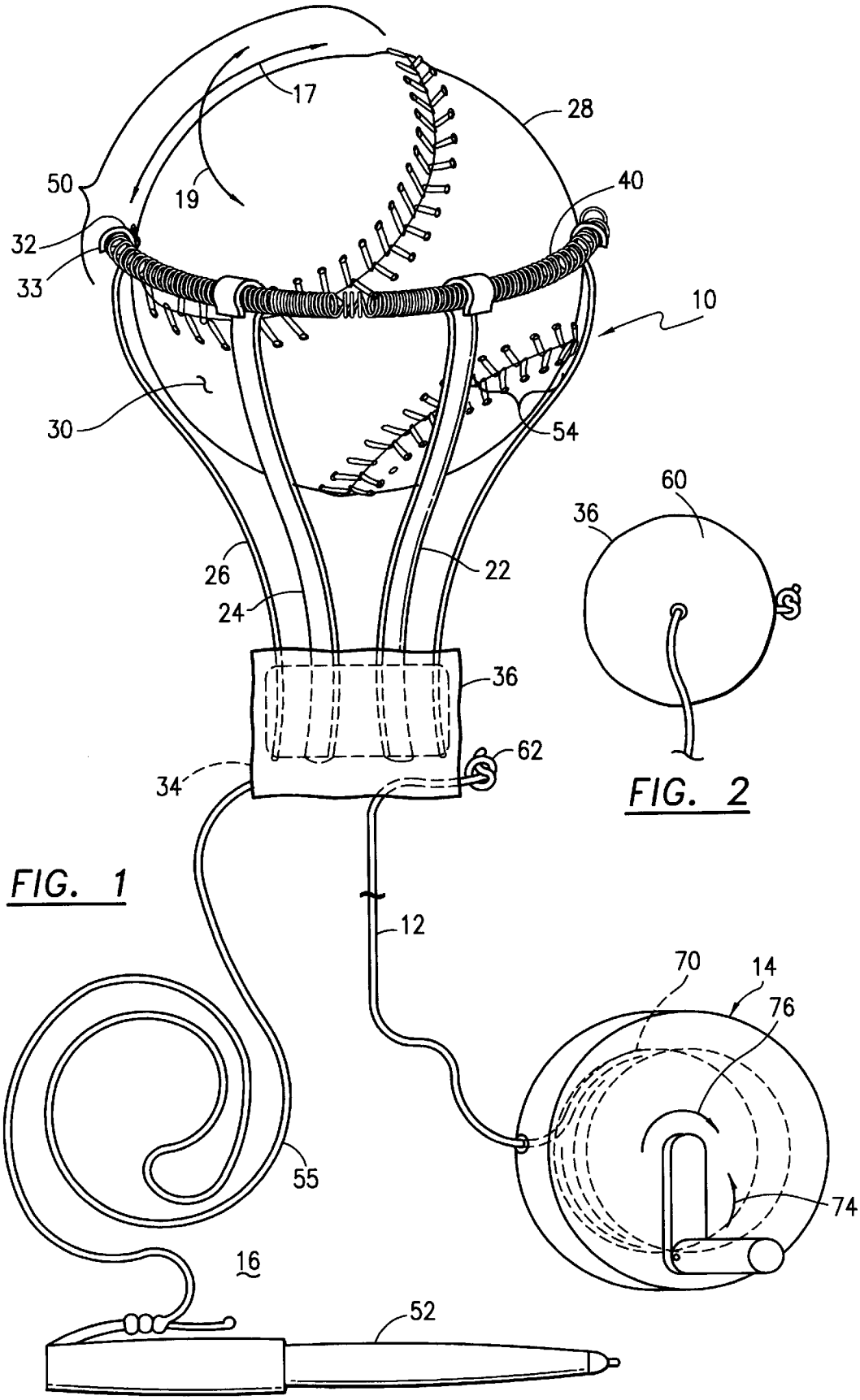
FIG. 1 diagrammatically illustrates the major components of the trolling system.
FIG. 2 diagrammatically illustrates the bottom end face of the rib end cage.

FIG. 1 diagrammatically illustrates the trolling system which generally includes a retractable ball basket 10, a drop cord 12, a reel system 14 and a writing instrument subsystem 16. Subsystem 16 includes pen or pencil 52 and short cord 54. Ball basket 10 includes a plurality of ribs some of which are illustrated as ribs 20,22,24 and 26. The ribs are spaced apart due to the pre-formed shape of the ribs and the presence of ball 28. The ribs, biased together, form a ball container defined in a central region 30 of ball basket 10. Each rib has an exposed or open terminal end. Terminal end 32 is associated with rib 26. The ribs also have a captured terminal end 34. The captured terminal ends of ribs 20, 22, 24 and 26 are captured by rib end cage 36. Cage 36 in this embodiment is cylindrical.

The exposed terminal ends 32 of ribs 20, 22, 24 and 26 are biased inward by a biasing mechanism which is illustrated as a spring 40 in FIG. 1.

In a preferred embodiment, the ribs are generally shaped to mate with or match the ball captured in central region 30. In one embodiment, the ribs are made of spring metal strips. Alternatively, the ribs can be made of resilient, rigid plastic.

Figure 3:
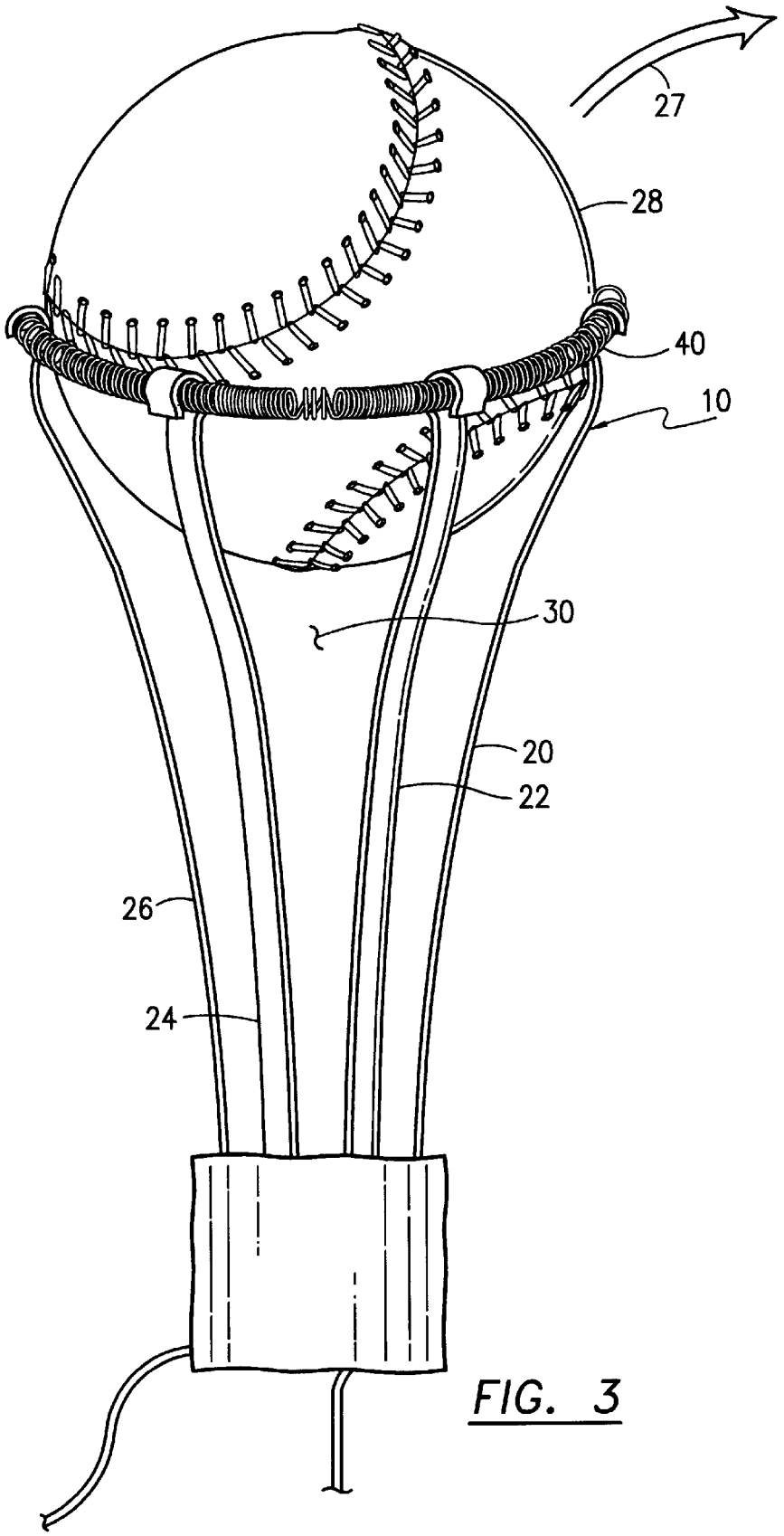
FIG. 3 diagrammatically illustrates removal of the ball from the ball basket.

In the illustrated embodiment, ribs 20, 22, 24 and 26 include end loops 33 specifically identified with respect to rib 26. Spring 40 passes through the plurality of end loops 33. Spring 40 enables the open end of ball basket 10 to be enlarged to enable ball 28 to be withdrawn from ball container region 30. See FIG. 3. In FIG. 3, arrow 27 shows the withdrawal of ball 28 from ball container central region 30.

The resilient and inboard biasing of ribs 20, 22, 24 and 26 in conjunction the open end biasing number 40 provides several important features of the present invention. First, ball 28 can be rotated in the direction shown by double headed arrows 17 and 19 in FIG. 1. Also, ball 28 can be easily withdrawn or inserted from and into ball container central region 30. See FIG. 3. Further and most importantly, the ballplayer can rotate the ball in the ball basket in order to locate an endorsement area 50. By simply rotating the ball in the ball basket, the player can easily place the ball endorsement area 50 at the top open region of the basket defined by the periphery of biasing spring 40. Thereafter, the player can grasp pen or pencil 52 attached to short cord 54 of subsystem 16 and write his or her endorsement on ball 28. Ball 28 is also relatively securely retained in the ball basket such that the ball does not rotate while the player endorses the ball. This is due to the inward bias of the ribs and the biasing action of spring 40.

Also, ribs 20,22,24 and 26 are laterally or circumferentially spaced apart thereby providing significant gaps 54 between each rib. See gap 54 between rib 20 and rib 22. The player can easily take pen or pencil 52 and write his or her name on ball 28 between the circumferential gap established between the plurality of ribs. In a preferred embodiment, six or eight ribs are utilized. However, at least four ribs should be utilized to capture ball 28 and form a stable ball containment region 30.

Rib end cage 36 captures the opposite terminal ends of ribs 20, 22, 24 and 26. A drop cord 12 is attached to the rib end cage 36. In a preferred embodiment, drop cord 12 extends from a central region of rib cage end face 60. This is shown in FIG. 2. One end 62 of drop cord 12 is tied or knotted such that the cord can be easily replaced, extended to or added to by untying knot 62 and adding additional drop cord.

The drop cord is captured by a reel system 14. In a preferred embodiment, reel system 14 includes a spindle 70 onto which is wound drop cord 12. Spindle 70 is rotated via handle 72. Handle 72 can collapse onto itself as shown by arrow 74 to provide a flat pack or compact wheel system. Handle 72 rotates in the direction shown by arrow 76 in order to wind up drop cord 12 thereon.

Figure 4:
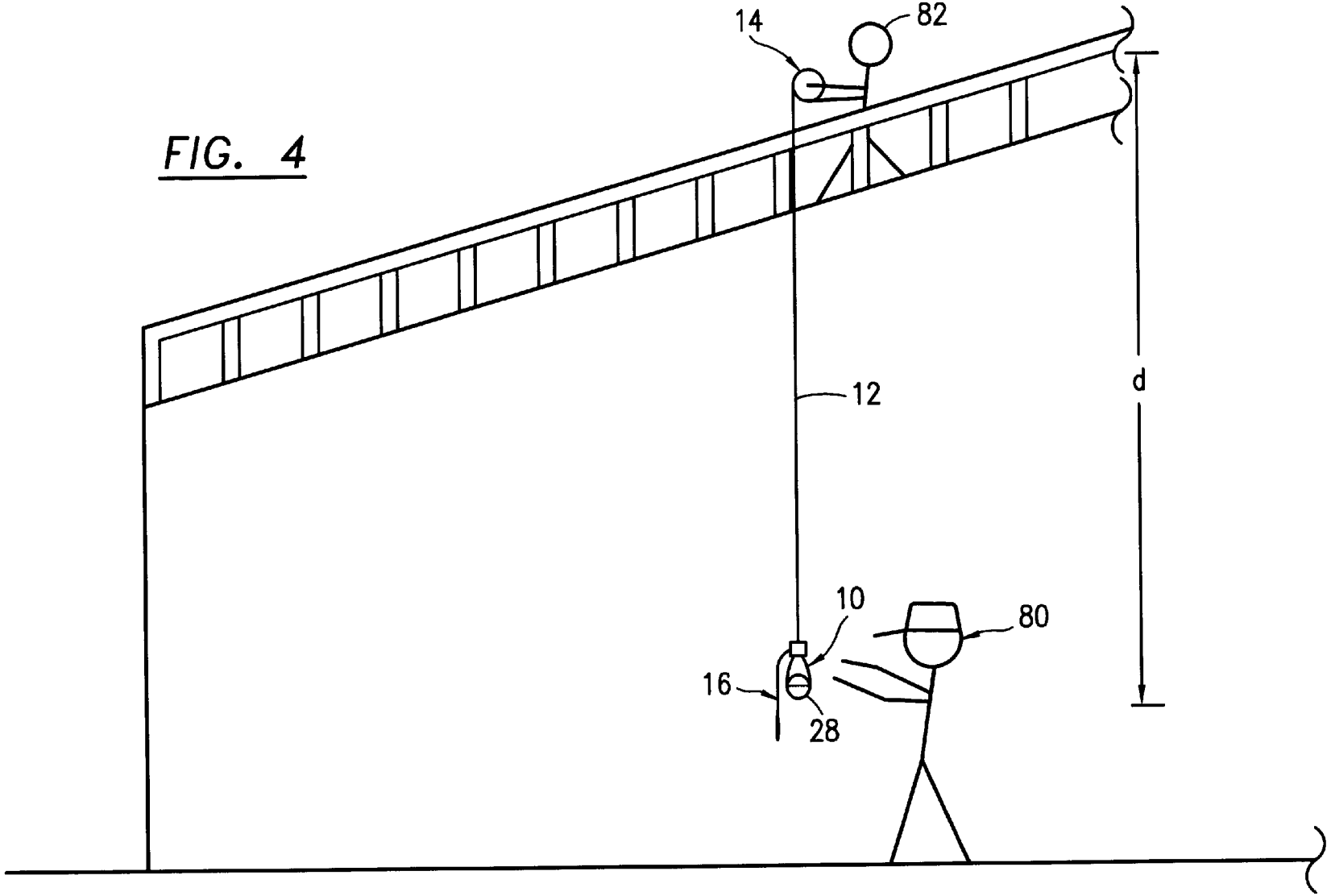
FIG. 4 diagrammatically illustrates an operational mode of the present invention wherein the ball basket has been lowered to a ballplayer enabling the player to endorse the ball while the fan retains the reel and the played out drop cord.

FIG. 4 diagrammatically illustrates ball player 80 and fan 82 in a stadium or an arena setting. Fan 82 is at an elevated distance d away from ballplayer 80. Fan 82 can lower ball basket 10 such that ball 28 is easily grasped and signed by ballplayer 80. Player 80 can hold ball basket 10, rotate ball 28 to an appropriate endorsement site, and write his or her name with endorsement subsystem 16 (pen 52). In a preferred embodiment, the drop cord is at least twenty feet long in order accommodate a twenty foot elevation d. After ballplayer 80 signs ball 28, fan 82 winds up drop cord 12 on reel system 14.

The cord described and shown herein can take many forms as shown in the following Cord Table.

CORD TABLE

| |
|---|
| Cord |
| Line |
| Wire |
| Rope |
| Tape |

The reel holding the wound drop cord can also take many shapes as shown in the following Reel Table.

REEL TABLE

| |
|---|
| Rotatable take-up reel |
| Bar which holds wrap around cord |
| Ladder which holds wrap around cord |

The following Ball Table lists balls which can be held by the retractable ball basket assuming the ribs and the biasing mechanism at the open end of the basket are configured to contain the ball therein.

BALL TABLE

| |
|---|
| Baseball |
| Football |
| Basketball |
| Soccer |
| Tennis |
| Hockey Puck |
| Golf |

The biasing member defining the open peripheral end of the ball basket can take many shapes and configurations. The following Biasing Member Table provides some example.

BIASING MEMBER TABLE

| |
|---|
| Expanding Spring |
| Elastic |
| Rubber band |
| Independent springs connected to adjacent terminal ends of each rib |
| Clip-on retainers connected between terminal ends of ribs |
| Independent tie-ons connected between ribs |
| Single tie-on looped through terminal ends of basket ribs |

Figure 5:
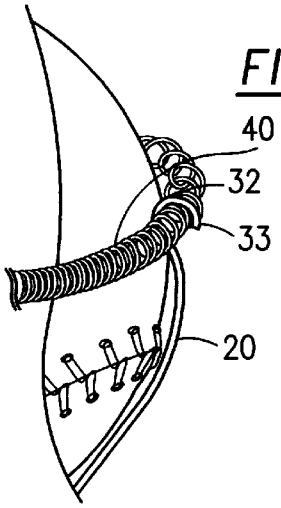
FIG. 5 diagrammatically illustrates the biasing system for the terminal open end of the plurality of ribs defining the ball container.
Figure 6:
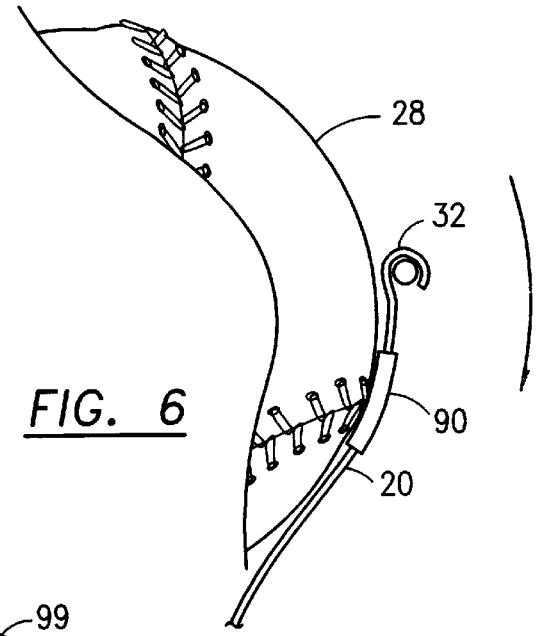
FIG. 6 diagrammatically illustrates the utilization of a plastic sleeve on the rib to limit movement of the ball in the ball basket; and, FIGS. 7, 8 and 9 diagrammatically illustrate the use of the trolling system with a football and a basketball or, alternatively, a tennis ball, or a golf ball and a hockey puck.

FIG. 5 diagrammatically illustrates a preferred embodiment of the present invention wherein rib 20 includes a loop around terminal loop 33 at terminal end 32. An expandable spring 40 passes through the opening defined by loop end 33. FIG. 6 diagrammatically shows rib 20 carrying a plastic sleeve 90 at a mid-region between rib end cage 36 (not shown in FIG. 6; shown in FIG. 1) and terminal end 32. Sleeve 90 provides several desirable features for the present invention. First, sleeve 90 securely holds ball 28 in the ball container central region 30. By providing a plastic sleeve 90 with a high coefficient of surface friction, the ball 28 will not rotate in the ball cage (ball container central region 30) when the ballplayer endorses ball 28. Also, plastic sleeve 90 cushions ball 28 such that the ball is not damaged by the inboard biasing of the plurality of ribs.

Figure 7:
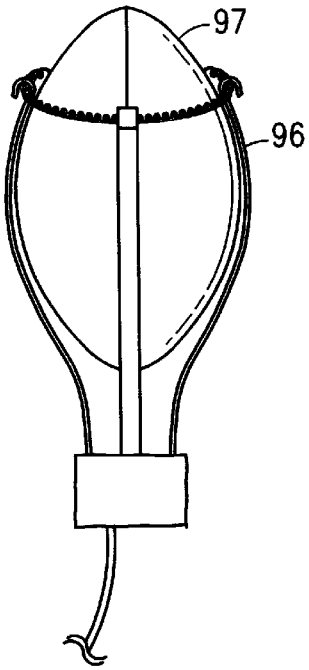
Figure 8:
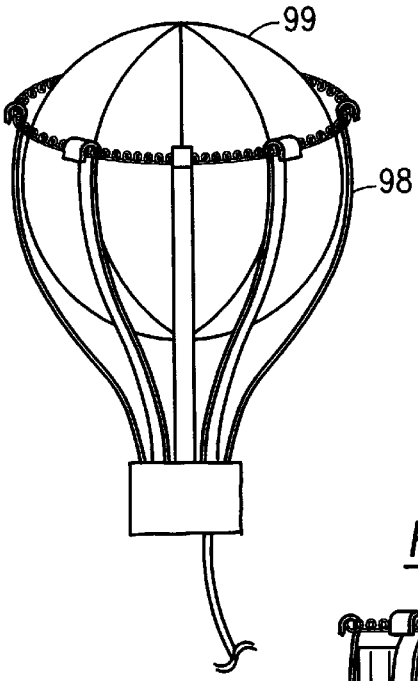

FIGS. 7 and 8 diagrammatically ball baskets 96 and 98 capturing football 97 and basketball or tennis ball or golf ball 99, respectively.

Figure 9:
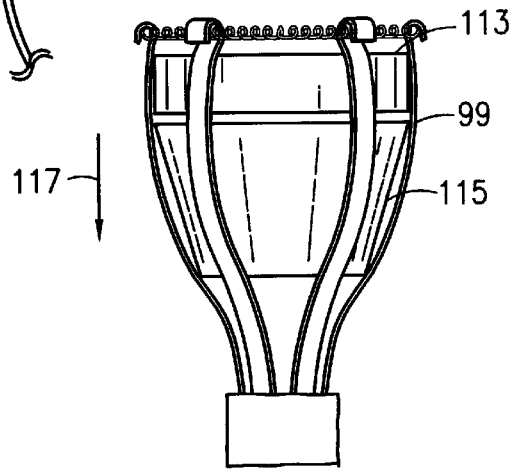

FIG. 9 diagrammatically illustrates basket 99 holding hockey puck 113 in the basket central region. Beneath puck 113 is a support unit 115 which limits the downward motion in the direction shown by arrow 117 of puck 113 in the central region of the basket. The structure of basket 99 is similar to that described in FIGS. 1 and 3. Support unit 115 may be frustoconical or may be shaped to conform to the central region of basket 99 excepting the upper region near the terminal biasing member reserved for puck 113.

The claims appended hereto are meant to cover modifications and changes within the scope and spirit of the present invention.

What is claimed is:

1. A trolling system for obtaining baseball player endorsements on a baseball including:

a drop cord with a terminal end;

a reel having wound thereon said drop cord, said reel having a means to dispense and retrieve said drop cord;

a retractable ball basket at said terminal end of said drop cord, said ball basket having a plurality of spaced apart biased ribs defining a ball container in a central region thereof, said biased ribs wrapping around said baseball and permitting endorsement access to said baseball via said spaced apart ribs; and a short cord having one end attached to said ball basket and another end attached to a writing instrument to enable said baseball player to endorse said ball captured in said ball basket.

2. A trolling system as claimed in claim 1 wherein said reel is a rotatable, wind-up reel which includes a spindle on which is wound said drop cord.

3. A trolling system as claimed in claim 2 wherein said drop cord is at least 20 feet long.

4. A trolling system as claimed in claim 1 wherein said ball basket is retractable by winding said drop cord on said reel.

5. A trolling system as claimed in claim 1 wherein said ball basket includes at least four biased ribs, each rib having a base, coupled to said drop cord, and a ball capture terminal end, and said basket includes means for biasing said terminal ends of said plurality of ribs inboard towards said ball.

6. A trolling system as claimed in claim 5 wherein said means for biasing is a spring.

7. A trolling system as claimed in claim 6 wherein said ribs are spring metal strips.

8. A trolling system as claimed in claim 2 wherein said reel includes a rotatable handle coupled to said spindle to enable an operator to dispense and retrieve said drop cord.

9. A trolling system for obtaining ballplayer endorsements on a ball including:

a drop cord with a terminal end;

a reel having wound thereon said drop cord, said reel having a means to dispense and retrieve said drop cord;

a retractable ball basket at said terminal end of said drop cord, said ball basket having a plurality of spaced apart biased ribs defining a ball container in a central region thereof, said biased ribs wrapping around said ball and permitting endorsement access to said ball via said spaced apart ribs; and a short cord having one end attached to said ball basket and another end attached to a writing instrument to enable said ballplayer to endorse said ball captured in said ball basket.

10. A trolling system as claimed in claim 9 wherein said reel is a rotatable, wind-up reel which includes a spindle on which is wound said drop cord.

11. A trolling system as claimed in claim 10 wherein said drop cord is at least 20 feet long.

12. A trolling system as claimed in claim 9 wherein said basket is retractable by winding said drop cord on said reel.

13. A trolling system as claimed in claim 9 wherein said basket includes at least four biased ribs, each rib having a base, coupled to said drop cord, and a capture terminal end, and said basket includes means for biasing said terminal ends of said plurality of ribs inboard towards one of said ball and said puck.

14. A trolling system as claimed in claim 13 wherein said means for biasing is a spring.

15. A trolling system as claimed in claim 14 wherein said ribs are spring metal strips.

16. A trolling system as claimed in claim 9 wherein the ball is one selected from the group consisting of a basketball, a football, a baseball, a soccer ball, a tennis ball, and a golf ball.

* * * * *